US005423398A

United States Patent [19]

Brown

[11] Patent Number: 5,423,398

[45] Date of Patent: Jun. 13, 1995

[54] MOBILE SUPPORT DEVICE FOR WINDOW WASHERS AND THE LIKE

[75] Inventor: Terry W. Brown, Newnan, Ga.

[73] Assignee: Sky Climber, Inc., Atlanta, Ga.

[21] Appl. No.: 129,465

[22] Filed: Sep. 29, 1993

[51] Int. Cl.[6] ..... E04G 3/10

[52] U.S. Cl. ..... 182/142; 182/37

[58] Field of Search ..... 182/36–38, 182/150, 142, 82

[56] References Cited

U.S. PATENT DOCUMENTS

| | | | |
|---|---|---|---|
| 2,881,029 | 4/1959 | Tollefsen | 182/37 X |
| 4,074,789 | 2/1978 | Warren et al. | 182/142 X |
| 4,542,804 | 9/1985 | Power | 182/150 X |

FOREIGN PATENT DOCUMENTS

| | | | |
|---|---|---|---|
| 2283280 | 4/1976 | France | 182/50 |

*Primary Examiner*—Alvin C. Chin-Shue
*Attorney, Agent, or Firm*—Hopkins & Thomas; James W. Kayden

[57] ABSTRACT

A movable support device for supporting a window-washer along a side wall of a building for cleaning windows. The device has a foldable framework that can be folded into a compact position for ease of handling and transport, and includes a pair of adjustable legs that engage and roll along the building side wall for mounting the mobile support device thereon. The device further includes wall engaging wheels that engage the upper surface of the parapet of the wall and are driven by a drive means remotely actuatable by a worker suspended from the device. The device is movable laterally along the upper surface of the parapet of the wall as necessary by the worker for cleaning windows across the face of the building.

9 Claims, 4 Drawing Sheets

MOBILE SUPPORT DEVICE FOR WINDOW WASHERS AND THE LIKE

FIELD OF THE INVENTION

This invention relates to a device placed on the roof of a building, specifically, on a parapet wall thereof, which allows a worker suspended from the device substantial movement horizontally and vertically on the side of the building. More particularly, this invention allows a worker, such as a window-washer, to access the sides of the building rapidly, efficiently and without assistance from another worker.

BACKGROUND OF THE INVENTION

To clean windows of multi-story buildings, it is necessary for workers to suspend themselves from the top of the building and move horizontally and vertically across the sides of the building. Accordingly, safety of the worker is a primary concern as is efficiency and quality of work done.

Some methods for window washing involve suspending the worker from some solid base on the roof. For example, the worker could simply tie off to a fixed object on the roof and rappel down the side of the building, washing windows within his reach on the way down the building. One obvious disadvantage of this method is that the worker has very limited horizontal movement. To cover an area of windows of substantial width, the worker has to return to the top of the building and move the rappeling line. However, the worker may encounter the problem of having limited fixed objects on which to tie off the line. To overcome this problem, some methods have utilized a support stand which the workers transport to the top of the building which they will move around on the building as needed. This support structure, however, must be weighted down to balance the weight of the worker suspended over the side of the building.

To overcome the disadvantages of the above methods, window washers have utilized devices which more easily move along the top of the building. Some devices roll along the roof of the building using counterweights to balance the suspended worker. A disadvantage of these devices is that such devices are difficult to roll, because they are weighted down. Also, the device may encounter loose gravel, drains, air conditioning units and other obstacles on the roof and a worker must provide clearance for the device around such obstacles. Another disadvantage of these devices is that the suspended worker must either come back to the top of the building and push the device over or a second worker is needed to push the device while the first worker is suspended.

In attempts to overcome these disadvantages, devices have been developed which have a means to move along the parapet or fire wall of the building instead of the roof top itself. Examples of such devices are Straw U.S. Pat. No. 3,059,721; Shaw U.S. Pat. No. 3,620,331; Dutcher U.S. Pat. No. 3,491,851; Camp U.S. Pat. No. 1,423,998; and Finley U.S. Pat. No. 5,065,838.

Straw teaches a ladder device which hangs over the wall and supports a worker thereon. The device will roll along the wall when pushed. This device has the obvious disadvantage of being very awkward to use, as the worker must physically climbup and down the ladder. In addition, use of this device is limited to relatively short buildings.

Shaw teaches a suspension device which can be physically moved along the parapet wall. The device is adjustable for fitting across walls of varying widths. However, its vertical legs are not adjustable in length. This means that the device is not adjustable to parapets of varying heights or to avoid obstacles on the inside or outside of the parapet wall, and further cannot be adjusted to compensate for the torque exerted on the device by the weight of the worker.

Camp teaches a scaffold carrier which can be adapted to fit across and move along a parapet wall. However, Camp nowhere suggests its use to suspend a window washer or the like and in fact does not show an easy means for safely suspending a worker from the device.

Finley teaches a movable support for suspending a worker. However, the device taught in Finley rolls along the building roof, as well as the parapet, which has disadvantages as discussed above. The device taught also utilizes a counterweight which further impedes its movement.

SUMMARY OF THE INVENTION

Briefly described, the present invention comprises a mobile support device for suspending workers from the roof of a building, which comprises a foldable framework that enables the apparatus to be folded into a compact unit for ease of handling and storage. The framework includes a horizontal support beam, which is generally a rectangularly shaped beam having a proximal end and a distal end. The horizontal support beam further has a pair of mounting struts attached to an upwardly facing side surface of the support beam. The mounting struts each include a series of aligned apertures or bores formed therealong. The horizontal support beam is positioned over the parapet of the outer side wall of the building adjacent the building roof, with the distal end of the horizontal support beam projecting over the side wall of the building, away from the roof of the building.

A drive means is mounted near the first end of the horizontal support beam, positioned over the surface of the building roof. The drive means includes a drive motor, such as, for example, a 24 volt low amp electric motor or similar drive motor powered by an electrical power source. Typically, the electrical power source comprises a battery or series of batteries such as two 12 volt gel-cell batteries mounted within a support housing attached to the proximal end of the horizontal support beam. The batteries provide a source of electrical power for the drive motor which, when actuated, drives a friction drive wheel rotatably mounted in an operative relationship with the drive motor. The batteries also act as a counterweight to help balance the device on the upper surface of the building wall. The drive wheel is positioned intermediate the proximal and distal ends of the horizontal support beam, adjacent the upper face thereof.

A pair of wall engaging wheels are rotatably mounted upon a support bracket attached to the proximal end of the horizontal support beam. The wall engaging wheels typically are pneumatic rubber tires or similar wheels which are adapted to engage and roll along the upper surface of the parapet of the building roof when the device is positioned over the parapet in its operative position. The drive wheel of the drive means is positioned above and engages one of the wall engaging wheels in frictional contact such that as the drive wheel is driven by the drive motor, it engages and rotates the wall engaging wheel. As a result of the actuation of the drive wheel, the device moves along the upper surface of the parapet of the building roof.

An adjustable inner support leg is attached to the proximal or first end of the horizontal support beam adjacent an inwardly facing side surface of the parapet of the building roof. The inner support leg typically is a C-shaped channel having a central web from which project a pair of spaced apart parallel side flanges. A series of aligned apertures are formed through the side flanges, through which a locking pin is received to lock the inner support leg to the first end of the horizontal support beam at a desired elevation. A support bracket is attached to the lower end of the inner support leg, to which a pair of rotatable wheel members are attached. The wheel members are generally rubber tires or the like and are adapted to engage and roll along the inner side surface of the parapet wall as the device is moved laterally along the parapet.

An outer support leg is adjustably mounted to the horizontal support beam, spaced from the inner support leg, and extending substantially parallel to and engaging the outer facing surface of the building side wall. The outer support leg is typically a telescoping beam having an attachment bracket mounted at its upper end, which is adapted to engage and slide along the length of the horizontal support beam for adjusting the lateral position of the outer support leg with respect to the inner support leg. A pair of wall engaging wheel members are rotatably attached to the lower end of the outer support leg, adapted to engage and roll along the outwardly facing surface of the building side wall as the device is moved along the parapet of the building.

A control means is mounted at the second or distal end of the horizontal support means. The controller typically is an electrical control box having a pair of control lines attached thereto which can be manipulated by the worker suspended from the apparatus to cause the movement of the apparatus along the parapet wall. The controller may also comprise a remote control means.

An attachment hook or clevis is mounted to the outer support leg adjacent the horizontal support beam. The clevis enables a suspension line or the like to be connected to the mobile support device from which a worker can be supported from the roof of the building to perform maintenance operations on the outwardly facing surfaces of the building.

Accordingly, it is an object of this invention to provide an improved mobile support device for supporting a worker from the roof of a building for the performance of maintenance services on the outer side walls of the building.

Another object of this invention is to provide a means for supporting a worker from the roof of a building which means is movable therealong to enable movement of the worker laterally across the building face.

Another object of this invention is to provide an improved method and device for washing windows of a multi-story building.

Another object of this invention is to provide an improved mobile support device for supporting a worker from the roof of a building during maintenance operations on the outer side surfaces of the building in which the points of engagement with the building wall are adjustable to compensate for the torque exerted thereupon by the weight of a worker and any tools or equipment.

Another object of this invention is to provide an improved mobile support device for supporting a worker from the roof of a building which provides enhanced stability and safety for workers performing maintenance operations on the outer side walls of a building.

Other objects, features, and advantages of the present invention will become apparent from the following detailed description, when read in conjunction with the attached drawings.

DETAILED DESCRIPTION OF THE PREFERRED EMBODIMENT

Figures 1, 2:
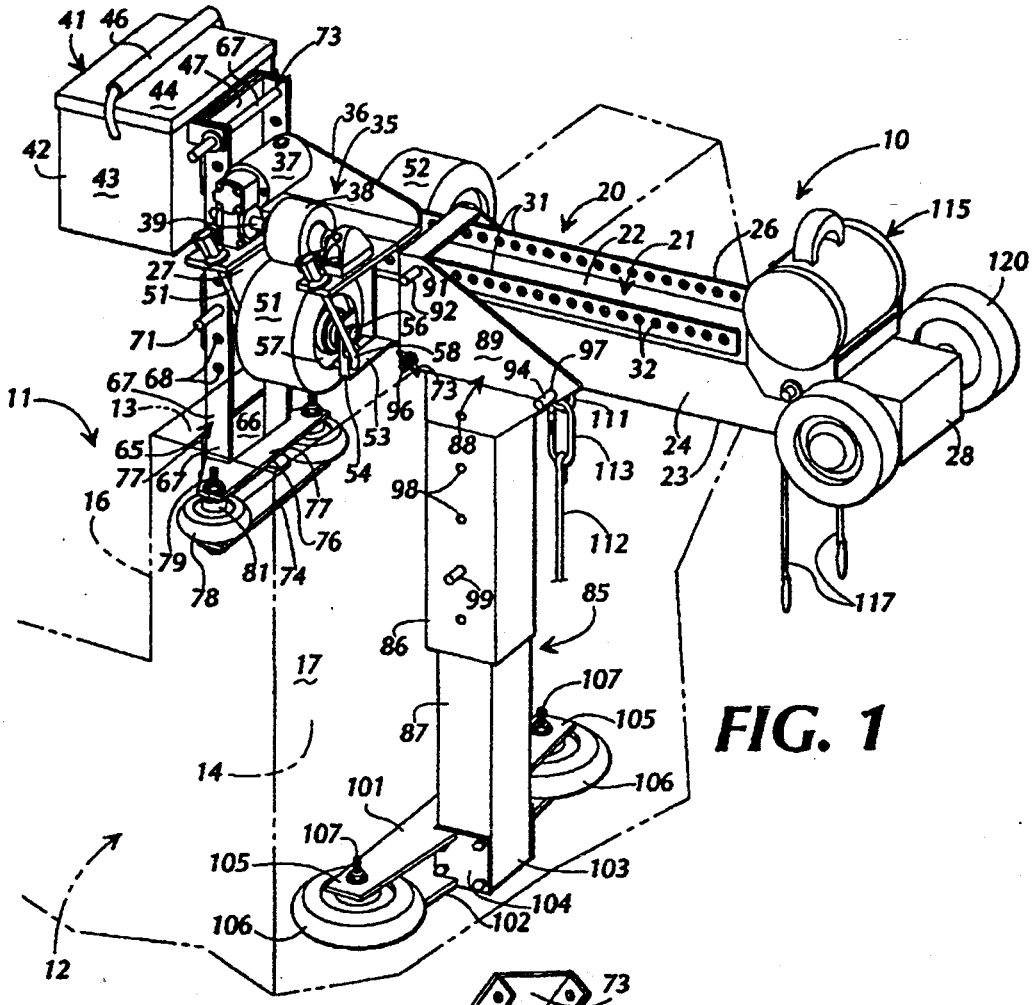
FIG. 1 is a perspective view of the device mounted over the parapet of the roof of a building.
FIG. 2 is a perspective illustration of the device for supporting a worker in its folded, storage, and transport configuration.

Referring now to the drawings in which like numerals indicate like parts throughout the several views, FIG. 1 illustrates a mobile support device 10 for supporting a worker from the roof 11 of a building 12. The mobile support device 10 is adapted to engage and mount upon the parapet or upper edge portion 13 of an outer side wall 14 of building 12, engaging the inwardly facing surface 16 and outwardly facing surface 17 of the building side wall 14 to support a worker suspended along the outwardly facing surface 17 of the building side wall.

Figure 3:
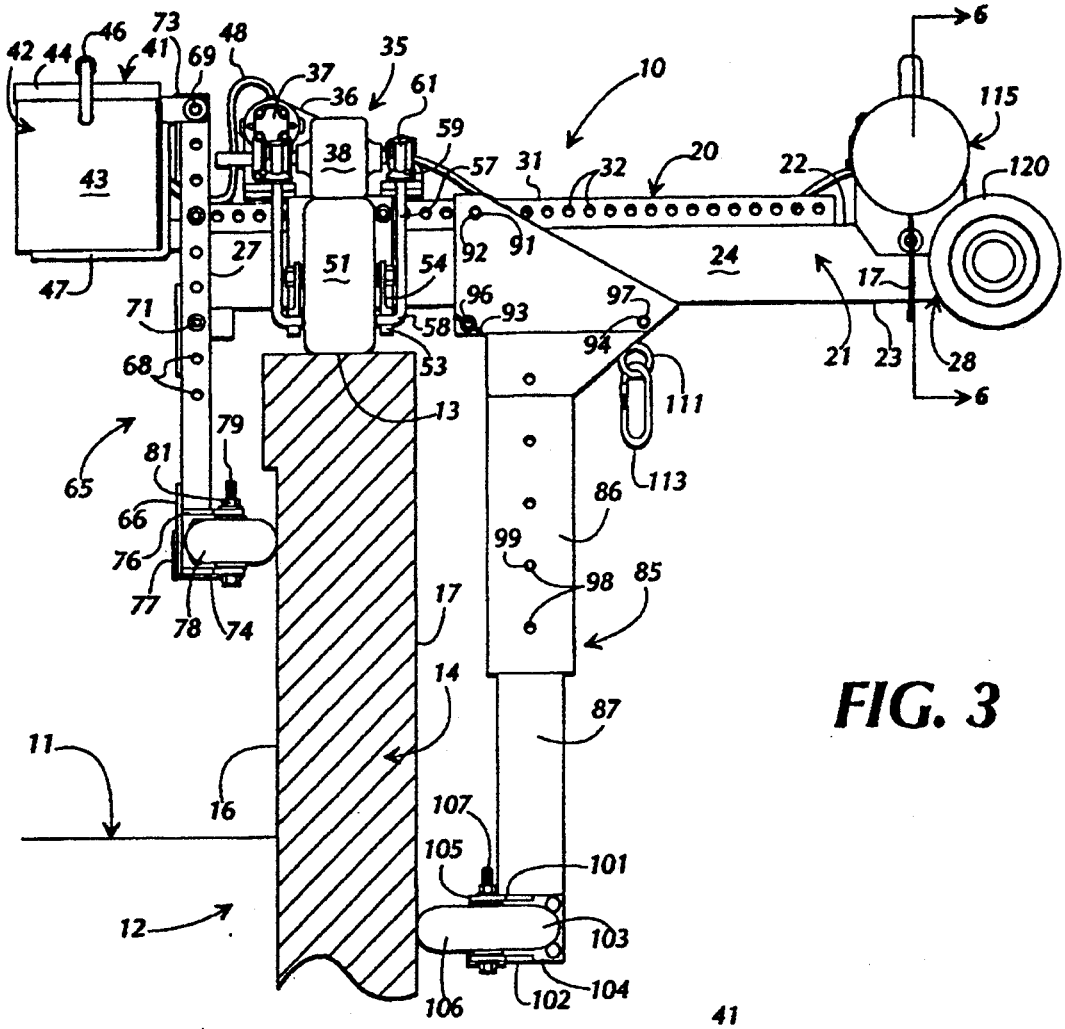
FIG. 3 is a side elevational view of the device illustrated as mounted upon the outer side wall of a building.

As shown in FIGS. 1–3, the mobile support device 10 has an adjustable, foldable framework or carriage 20, which can be folded into a compact position, indicated in FIG. 2, for ease of storage and transport. The device can be unfolded into an operative position as illustrated in FIGS. 1 and 3 for mounting on the parapet 13 of the building side wall 14 for use in cleaning windows, making repairs, etc. The framework includes a horizontal support beam 21, which is extended over and projects outwardly from the building outer side wall. The horizontal support beam generally is a substantially rectangularly shaped box beam formed from steel or similar metal, although other materials and shapes, such as a C-channel can be used. The horizontal support beam includes upper and lower surfaces 22 and 23 and side surfaces 24 and 26. The horizontal support beam further includes a first or proximal end generally positioned over the roof 11 of the building 12 adjacent the inwardly facing surface 16 of the building wall 14, and a second or distal end 28 that projects over and is spaced from the outwardly facing surface 17 of the building side wall.

As illustrated in FIGS. 1 and 3, mounting struts 31 are attached to the upper surface 22 of the horizontal support beam 21, as by welding. The mounting struts 31 typically are metal strips such as steel straps or bars of a length slightly less than the length of the horizontal support beam and extending partially along the length of the horizontal support beam. A series of aligned bores or apertures 32 are formed in the mounting struts 31 for the receipt of a locking pin or similar locking means therethrough.

A drive means 35 is mounted along the upper surface 22 of the horizontal support beam 21 adjacent the proximal end 27 thereof. The drive means 35 is mounted upon a substantially L-shaped support plate 36, which is adjustably mounted to the mounting struts 31 of the horizontal support beam. The support plate is movable along the length of the horizontal support beam and has a pair of locking pin openings that are alignable with the locking pin openings of the mounting struts in order to adjust the positioning of the drive means relative to the parapet wall, thus accommodating walls of different widths. Lock-pins (not shown) are inserted through aligned openings of the mounting struts and support plate to secure the support plate in a desired position. The drive means 35 further includes a drive motor 37 attached to support plate 36. The drive motor 37 typically is an electric motor such as a 24 volt low amp electric motor or similar motor. A drive wheel 38 is positioned adjacent the drive motor 37 and is connected to the drive motor in a driving relationship to the drive motor 37 by a drive shaft 39. The actuation of the drive motor causes the drive shaft 39 to rotate to cause the rotation of the drive wheel 38.

Figure 5:
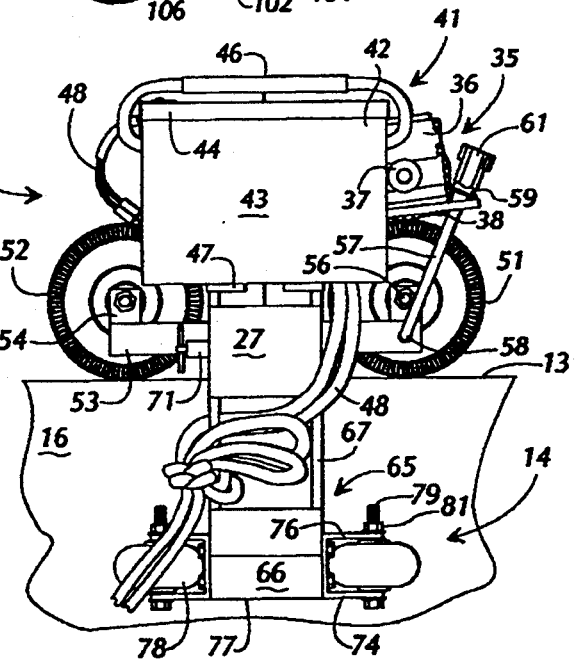
FIG. 5 is an end elevational view of the inner vertical support leg and the wall engaging wheels, illustrating the tension means applied to the drive wheel and wall engaging wheels.
Figure 4:
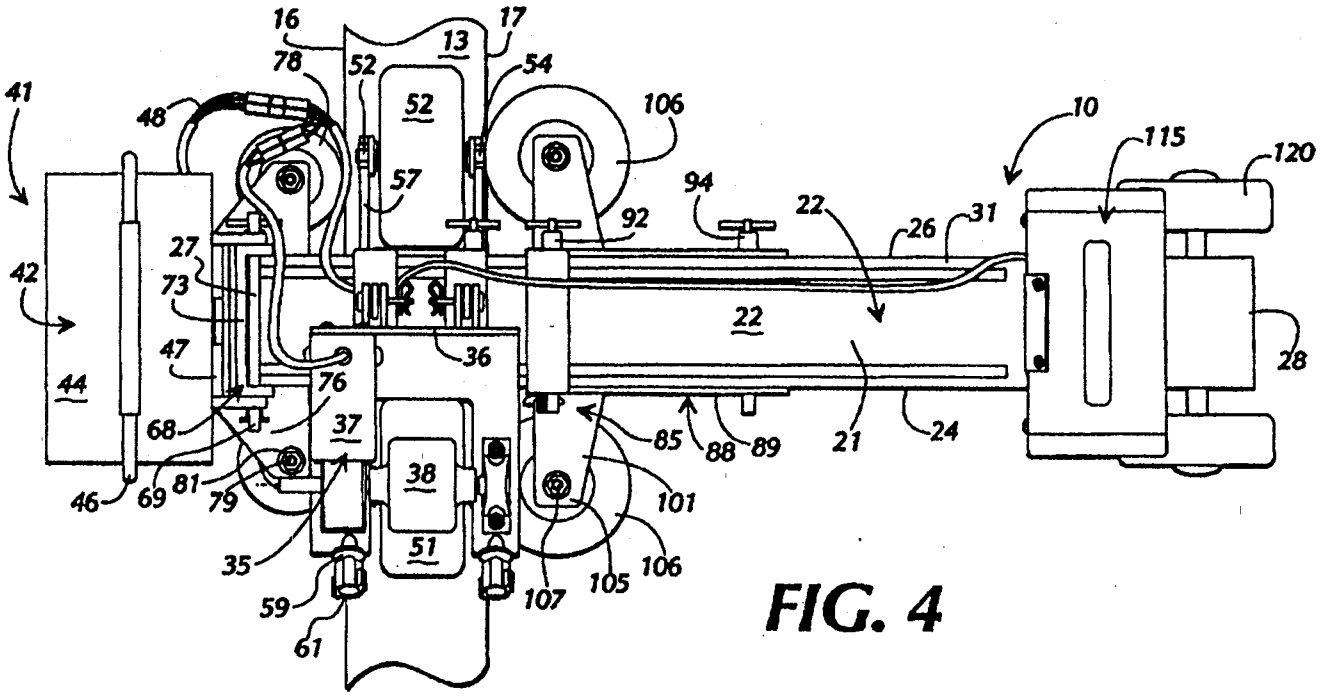
FIG. 4 is a plan view of the device for supporting a worker from a building roof.

A power supply 41 for the drive means is positioned at the proximal end 27 of the horizontal support beam 31, adjacent the drive means 35. The power supply typically is an electric power source such as a pair of 12 volt gel-cell batteries mounted within a support housing or casing 42 (FIGS. 3–5). The casing 42 is a substantially rectangularly shaped box 43 having a removable lid 44 mounted thereover and having a handle 46 attached thereto for ease of transport. The casing 42 is mounted to the proximal end 27 of the horizontal support beam 21 by an L-shaped bracket 47. The power supply 41 is linked to the drive motor 37 by a series of electrical conduits 38 and supplies the power for actuation and operation of the drive motor. The batteries and support bracket of the power supply also act as a counter-weight at the proximal end of the horizontal support beam so as to balance the weight applied to the horizontal support beam by the worker suspended therefrom to resist tipping and to provide greater stability to the device. The structure of the device, with the counterweight in a raised position, ensures that the device is not interfered with by structural elements or other obstructions on the roof.

As shown in FIGS. 1, 3, 4, and 5, a pair of wall engaging wheels 51 and 52 is rotatably mounted to a pair of laterally extending struts 53. The struts are attached to the lower surface 23 of the horizontal support beam 21 and each include upwardly extending portions 54 at each end thereof. As shown in FIG. 4, the wall engaging wheels 51 and 52 are positioned between and are supported by the spaced struts 53. Pivot pins 56 (FIGS. 3 and 5) are extended through openings formed in the upwardly extending portions 54 of the struts 53 and through the hubs of the wall engaging wheels to attach the wall engaging wheels rotatably to the struts. The wall engaging wheels roll along the parapet to move the device along the roof of the building. The mounting of the wall engaging wheels in a spaced arrangement enables the wall engaging wheels to follow the contour of the building parapet. This allows the device to move along curved building walls as well as substantially straight walls.

As shown in FIGS. 3–5, the drive wheel 38 of the drive means 35 is mounted in frictional engagement with wall engaging wheel 51. As a result, as the drive wheel 38 is rotated by the actuation of the drive motor 37, such rotation in turn causes wall engaging wheel 51 to rotate. As a result, the mobile support device is moved along the length of the parapet 13 (FIG. 1) of the building. As shown in FIGS. 1 and 3, a pair of tension rods 57 are attached at one end to the ends of the struts 53 adjacent wall engaging wheel 51. The tension rods 57 are secured by lock nuts 61 at their opposite ends 59 to the support plate 36 for the drive means. The tension rods 57 maintain the drive wheel 38 and wall engaging wheel 51 in constant tight frictional contact during operation of the mobile support device 10 so that the drive wheel will not tend to slip or spin when first actuated while engaging wheel 51. Thus, by maintaining the drive wheel and wall engaging wheel 51 in tight frictional contact, slipping or false starts are avoided.

As shown in FIGS. 1 and 3, an inner support leg is adjustably attached to the proximal end 27 of the horizontal support beam 21, attached to the mounting struts 31 of the horizontal support beam. The inside support leg 65 is generally a C-shaped channel formed from a metal such as steel or other rigid material. This leg has a web portion 66 from which project a pair of side flanges 67. A series of spaced, aligned bores or apertures 68 are formed substantially along the length of the side flanges 67. The bores enable the inside support leg 65 to be adjusted vertically with respect to the proximal end of the horizontal support beam as necessary to provide balanced support. The inside support leg is adjusted vertically to an optimum position for engaging the inwardly facing surface of the building wall and is secured to the proximal end of the horizontal support beam.

As illustrated in FIG. 3, a first locking pin 69 is inserted through the aligned bores 68 of the side flanges 67 of the inside support leg and the bores 32 of the mounting struts mounted to the upper surface of the horizontal support beam. A second locking pin 71 is inserted through the bores 68 of the side flanges of the inside support leg and through a locking flange 72 mounted to the lower surface 23 of the horizontal support beam 21. As a result, the inside support leg is securely mounted to the proximal end of the horizontal support beam. As FIG. 1 illustrates, the L-shaped bracket 47 for the power supply housing 42 is attached to the upper end 73 of the inside support leg 65 by a lock-pin inserted through the uppermost bores of the inside support leg and through the upper end of the L-shaped bracket to mount the housing to the proximal end of the horizontal support beam.

As shown in FIGS. 1–3, a pair of spaced mounting plates 74 and 76 are attached adjacent the lower end 77 of the inside support leg 65. A pair of spaced rollers or similar wheel members 78 are mounted between the spaced mounting plates 74 and 76, at the ends thereof. The wheel members 78 generally are pneumatic or solid core rubber tires. Pivot pin 79 or similar locking pins are inserted through the mounting plates adjacent the ends thereof and through the wheel member 78 and are secured by lock nuts 81, or similar fastening means. The wheel members 78 are rotatable about the pivot pins such that as the mobile support device is moved along the length of the building wall, the wheel members engage and roll along the inwardly facing surface 16 of the building wall to maintain the position of the mobile support device on top of the building wall. The wheel members are normally formed from rubber or similar material that will frictionally engage the inwardly facing surface of the building wall.

As FIGS. 1 and 3 illustrate, an outer support leg 85 is adjustably mounted to the horizontal support beam 21, on the opposite side of and spaced from the wall engaging wheels 78 of the inside support leg 65. The outer support leg 85 is generally a rectangularly shaped telescoping beam having an upper sleeve 86 and a lower box beam section 87. The lower box beam section 87 is received within and telescopes into the upper sleeve to enable adjustment of the length of the outer support leg vertically along the outer side surface of the building wall. The upper sleeve 86 is mounted to a substantially triangular shaped sliding bracket 88, which fits over and slides along the length of the horizontal support beam 21. As FIG. 1 illustrates, the support bracket 88 includes a pair of substantially triangular side plates 89 spaced from one another to receive the horizontal support beam therebetween. Aligned locking pin openings 91 are formed through the side plates 89 of the support bracket 88 adjacent an upper corner thereof. The locking pin openings 91 are alignable with the bores 32 of the mounting struts 31. A locking pin 92 is insertable through the aligned bores and locking pin openings to secure the mounting bracket 88 in a set position along the length of the horizontal support beam. As a result, the spacing between the outer support leg and the inner support leg can be varied as desired to accommodate roof parapets of different widths. In addition, the brackets which support the wall-engaging wheels 78 and 106 are also horizontally adjustable with respect to their support legs 65 and 85, respectively, to accommodate parapet walls having differing contours.

As shown in FIGS. 1 and 3, additional locking pins 93 and 94 are insertable through bores 96 and 97 formed along the lower edges of the side plates 89 of the mounting bracket. The locking pins secure the upper edge of the upper sleeve of the outer support leg adjacent the lower surface 23 of the horizontal support beam. This locks the outer support leg in an operative position extending parallel to the inside support leg 65 and normal to the horizontal support beam. A series of openings 98 are also formed through the upper sleeve 86 and through the lower box beam section 87 of the outer support leg 85. As the outer support leg is adjusted to a desired length for engaging the outwardly facing surface of the building wall, a locking pin 99 is inserted through the openings 98 of the upper sleeve and lower section of the outer support leg to fix the outer support leg at a desired and optimum length.

A pair of mounting plates 101 and 102 are attached at the lower end 103 of the lower section 87 of the outer support leg 85. The mounting plates 101 and 102 are substantially rectangularly shaped straps of metal attached approximately in their centers to the lower section of the outer support leg by a bracket or similar fastening means 104. The ends 105 of the mounting plates project laterally from the sides of the lower section of the outer support leg. A pair of wheel members 106 or rollers are rotatably mounted between the ends 105 of the mounting plates 101 and 102. The wheel members 106 are also pneumatic or solid core tires or rollers formed from rubber or similar material adapted to frictionally engage the outwardly facing surface of the building side wall as the mobile support device is moved therealong. Pivot pins 107 are extended through the ends 105 of the mounting plates 101 and 102 and through the hubs of the wheel members and are secured by lock nuts 108 or similar fastening means. The pivot pins function as axles about which the wheel members rotate as the wheel members engage and roll along the outwardly facing side wall of the building.

As illustrated in FIG. 3, a mounting bolt, such as an eye-bolt or clevis 111, is attached to the upper sleeve 86 of the outer support leg 85 adjacent the upper end thereof. The mounting bolt 111 provides a means for connection of a suspension line 112 or the like, as by a clasp connector 113, to the mobile support device for suspending and supporting a worker therefrom.

Figure 6:
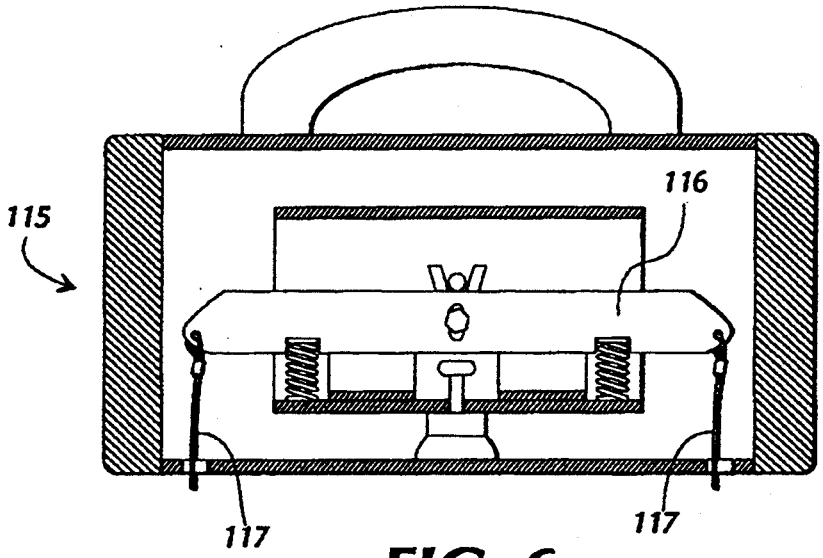
FIG. 6 is an end elevational view of the controller for the device, taken in cross-section along lines 6—6 of FIG. 5.

As shown in FIGS. 1–3, a controller 115 is mounted to the horizontal support beam 21 adjacent the distal end 28 thereof. The controller is generally an electrical switch mechanism such as is illustrated in FIG. 6. As shown in FIG. 6, the controller includes a pivot arm 116 pivotally mounted at its center. A pair of control cables or lanyards 117 are mounted at each end of the pivot arm 116 and hang downwardly therefrom for actuating the controller. The controller 115 is connected to and communicates with the drive motor 35 of the drive means via electrical conduits that extend along the length of the horizontal support beam. As a worker supported by the mobile support device pulls on one or the other of the control cables, an electrical signal is generated by the controller 115, which is communicated to the drive means, to cause the drive motor 37 to rotate the drive wheel 38 in a forward or reverse direction to cause the movement of the mobile support device along the building side wall. As an alternative, this controller may be designed as an infrared remote control system for directing the movement of the present device.

As shown in FIG. 2, a pair of support wheels 120 are rotatably mounted to the distal end 28 of the horizontal support beam 21. These support wheels are also typically solid core or pneumatic tires formed from rubber or similar material. The support wheels provide a means for rolling the mobile support device during transport when the mobile support device is in its folded inoperative configuration, illustrated in FIG. 2, for ease of transport and handling.

Further, by enabling the device to be folded into a compact inoperative configuration, the device can be easily lifted and carried and efficiently stored in a car or truck for transport without requiring a significant amount of space. Additionally, the compact configuration enables the device to easily fit through narrow openings such as doorways and hatchways leading to the roofs of buildings.

OPERATION

In the use and operation of the present device, the mobile support device 10 is transported to a work-site in its folded configuration, as illustrated in FIG. 2. In its folded configuration, the device may be carried in the back of a truck, van, or other vehicle with only a limited amount of space necessary for transport. At the work-site, the device is unloaded and wheeled through the building on support wheels 120 to a rooftop elevator or hatch leading to the roof of the building. Once received on the roof, the mobile support device 10 is unfolded into its operative position illustrated in FIGS. 1 and 3.

To assemble the device for use, the worker simply folds out the outer support leg 85 to a position wherein its upper end abuts the lower surface 23 of the horizontal support beam 21 of the mobile support device 10. Locking pins 93 and 94 are inserted through bores 96 and 97 of the side plates 89 of bracket 88 to lock the outer support leg in its operative position extending parallel to the inside support leg 65 of the device and normal to the horizontal support beam. Thereafter, the casing 42, in which is contained the batteries of the power supply 41, is mounted to the proximal end 27 of the horizontal support beam by an L-shaped bracket 47 attached to the upper end of the inside support leg 65. Thus, the device is quickly and easily assembled into its operative configuration as indicated in FIGS. 1 and 3 with a minimum of effort and time.

The spacing between the inside support leg 65 and the outer support leg 85 is adjusted by the worker to match the width of the parapet 13 of the building side wall 14 upon which the mobile support device 10 is to be positioned. Thereafter, the support legs are adjusted longitudinally to provide for optimum balance of the device on the parapet of the wall. The length of the inside support leg 65 is adjusted by lengthening or shortening the leg as desired to a position wherein the wheel members 78 of the inside support leg engage the inwardly facing surface 16 of the building side wall 14, adjacent the upper surface of the roof 11 of the building 12. Locking pins 69 and 71 are inserted through bores 68 of the side flanges of the inside support leg to secure the inside support leg at the desired length. The outer support leg 85 is likewise adjusted to a desired length for the optimum balance of the device on the parapet by telescoping the lower box beam section 87 into or out of the upper sleeve 86 of the outer support leg. A locking pin 99 is inserted through aligned locking pin openings 98 of the upper sleeve and lower box beam section to lock the lower box beam section at a desired length.

As illustrated in FIGS. 1 and 3, once the device has been adjusted to achieve the optimum balance of the device on the building parapet, the mobile support device 20 is positioned upon the parapet 13 in a straddling, contacting relationship with the wall engaging wheels 51 and 52 of the device engaging and resting upon the upper surface of the parapet 13. The wheel members 78 of the inside support leg engage the inwardly facing surface 16 of the building wall and the wheel members 106 of the outer support leg 105 engage the outwardly facing surface 17 of the building wall in order to secure the device against tipping or otherwise becoming disengaged from the parapet.

Further, the power source 41 positioned at the proximal end 27 of the horizontal support beam 20 provides a counter-weight to balance against the weight of the workers suspended from the device. With such a configuration, the device is thus securely mounted over the parapet of the building and is maintained in tight contact with the building side wall to prevent the device from tipping or falling over the parapet as the weight of a window-washer is applied to the device.

With the device positioned upon the parapet, the worker attaches a suspension line 112 to mounting bolt 111, and attaches this suspension line to a support chair or harness. The worker then climbs over the edge of the wall to a position suspended from the horizontal support beam by the suspension line, in a position to wash the building windows. Generally, the worker will start at one edge of the side wall of the building and will work laterally across the building, cleaning the windows from one side to the other. The worker controls the movement of the device by the actuation of the control means, the controller 115 through the manipulation of control cables 117. As the worker finishes a window, the worker actuates the controller, which causes the drive means 35 of the device to actuate, engaging drive wheel 38. The drive wheel 38 engages wall engaging wheel 51, and causes it to rotate so as to cause the device to move along the upper surface of the building wall.

The worker continues laterally across the face of the building, cleaning the windows of the uppermost row of windows to be cleaned. Once a row of windows is cleaned, the worker simply lowers himself/herself to the next row of windows and then proceeds laterally back across the face of the building. As a result, all of the windows at the same approximate height are cleaned in sequence so that windows which have been previously cleaned do not become spotted or dirty as the next series of windows are cleaned.

The process is repeated until all of the windows on the side of the building are cleaned. The present device thus enables the window-washer to clean the windows of a building more efficiently and quickly as the window-washer does not have to continually return to the top of the building to move the device over to the next series of windows. Instead, it is only necessary for the window-washer to move the device to the next side of the building, for square or rectangular buildings, once all of the windows on one side of the building have been cleaned. Additionally, for curved or round buildings, the device is able to track the contour of the building side wall so that the worker can continue around the outer side wall of the building without having to manually reposition the device to clean an additional series of windows.

The present device thus provides a window-washing apparatus that is simple and easy to assemble and use, and breaks down into a compact configuration for ease of transport and handling. Further, the present device enables the window-washer to clean the windows of a building much more efficiently without the problem of previously cleaned windows becoming spotted or dirty as adjacent windows are cleaned.

It will be understood by those skilled in the art that while a preferred embodiment of the invention has been disclosed above, various modifications and changes can be made hereto without departing from the spirit and scope of the present invention.

I claim:

1. A movable support device for suspending a person over the parapet of a building, comprising:

a generally horizontal support beam adapted to extend transversely over the parapet;

an inside support leg assembly adjustably mounted to said horizontal support beam, extending substantially normal to said horizontal beam and having a wheel means positioned so as to engage and roll along an inside surface of the parapet;

an outer support leg assembly adjustably mounted to said horizontal support beam spaced from and extending substantially parallel to said inside support leg assembly and substantially normal to said horizontal beam, said outside support leg assembly having an upper sleeve and a lower section that telescopes into said upper sleeve for adjusting the length of said outside support leg assembly as desired and wheel means positioned to engage and roll along an outside surface of the building;

means for adjusting the spacing between said inside support leg assembly and the outside support leg assembly;

a pair of wheels rotatably mounted to said horizontal support beam between said inside support leg assembly and said outer support leg assembly and positioned so as to engage and move along an upper surface of the outer side wall of the building for moving the carriage therealong;

drive means mounted on said horizontal beam between said inside support leg assembly and said outer leg assembly adjacent said wheels, wherein said drive means comprises a drive wheel and motor means linked in a driving relationship, said drive wheel mounted in frictional engagement with one of said wall engaging wheels, with said drive wheel controlled by said motor means, so that as said drive wheel is rotated by said motor means, said wall engaging wheels are rotated to move the device along the upper surface of the parapet; and control means mounted at one end of said support beam for controlling said drive means for directing the movement of the device.

2. The device of claim 1 wherein said wheel means of said inside support leg comprises a pair of spaced wheels adapted to engage and roll along a side wall of the building.

3. The device of claim 1 wherein said wheel means of the outside support leg comprises a pair of spaced wheels adapted to engage and roll along a side wall of the building.

4. The device of claim 1 further comprising at least one battery for powering said drive means.

5. The device of claim 4 wherein said battery is mounted in a casing which is detachably connected to said horizontal support beam.

6. A movable support device for suspending a person over the parapet of a building, comprising:

a generally horizontal support beam adapted to extend transversely over the parapet;

an inside support leg assembly adjustably mounted to said horizontal support beam, extending substantially normal to said horizontal beam and having a wheel means positioned so as to engage and roll along an inside surface of the parapet;

an outer support leg assembly adjustably mounted to said horizontal support beam spaced from and extending substantially parallel to said inside support leg assembly and substantially normal to said horizontal beam, said outside support leg assembly having an upper sleeve and a lower section that telescopes into said upper sleeve for adjusting the length of said outside support leg assembly as desired and wheel means positioned to engage and roll along an outside surface of the building;

wherein said horizontal beam comprises a rectangular beam formed from a metal material having a series of mounting struts attached to an upper surface thereof, said mounting struts having a series of aligned bores through which locking pins are received for varying the spacing between the inside support leg and the outside support leg assembly;

wheel means rotatably mounted to said horizontal support beam between said inside support leg assembly and said outer support leg assembly and positioned so as to engage and move along an upper surface of the outer side wall of the building for moving the carriage therealong;

drive means mounted on said horizontal beam between said inside support leg assembly and said outer support leg assembly adjacent said wheel means for rotating said wheel means for moving the device along the parapet of the building; and control means mounted at one end of said support beam for controlling said drive means for directing the movement of the device.

7. A movable support device for supporting workers along an outer side wall of a building, comprising:

a carriage adapted to straddle and move along an upper surface of the building wall, said carriage including a horizontal support member that projects over and outwardly from the upper surface of the building wall, an inner vertical support member mounted to one end of said horizontal support member, positioned adjacent an inner face of the building wall and vertically adjustable with respect to said horizontal support member for engaging the inner face of the building outer side wall as said carriage moves therealong, and an outer vertical support member adjustably mounted along said horizontal support member extending downwardly therefrom and vertically adjustable with respect to said horizontal support member, adapted to engage and move along an outer face of the building outer side wall as the carriage is moved along the side wall of the building;

wheel means rotatably mounted to said carriage between said inner and outer vertical support members and positioned so as to engage and move along an upper surface of the outer side wall of the building for moving the carriage therealong;

drive means comprising a drive motor mounted to said horizontal support member intermediate the ends thereof, a drive wheel connected to said drive motor in a driving relationship and positioned to frictionally engage said wheel means such that as said drive wheel is rotated by said drive motor, said wheel means is caused to rotate in response thereto;

a controller communicating with said drive means for actuating said drive means for controlling movement of said carriage along the building wall;

means for suspending a worker adjacent the outer side wall of the building mounted to said carriage adjacent said outer vertical support member;

said carriage positioned over the upper surface of the outer side wall of a building in a straddling relationship engaging the upper surface of the wall, with said inner and outer support members also being laterally adjustable along said horizontal support member so as to accommodate the width of the outer side wall and engage the inner and outer faces to stabilize and secure said carriage upon the upper surface of the building wall to prevent said carriage from becoming unseated from the building wall as the carriage is moved along the upper surface of the building wall by said drive means for performing maintenance operations on the building wall.

8. The device of claim 7 and wherein said wheel means comprises a pair of wall engaging wheels rotatably attached to said horizontal support member and tensioning rods extending between and attached to said wall engaging wheels and said horizontal support member for maintaining the frictional engagement between said drive wheel and said wall engaging wheels.

9. The device of claim 7 and wherein said inner and outer support members each include wheels rotatably mounted thereto.

* * * * *